US005368296A

United States Patent [19]

Liu

[11] Patent Number: 5,368,296

[45] Date of Patent: Nov. 29, 1994

[54] GAME RACKET FRAME

[76] Inventor: Leueis Liu, No. 8, Alley 23, Lane 684, Yuan Huan East Rd., Feng Yuan, Taichung Hsien, Taiwan, Prov. of China

[21] Appl. No.: 971,560

[22] Filed: Nov. 5, 1992

[51] Int. Cl.[5] ..... A63B 49/02

[52] U.S. Cl. ..... 273/73 C

[58] Field of Search ..... 273/73 R, 73 C, 73 D, 273/73 G, 73 H, 73 K

[56] References Cited

U.S. PATENT DOCUMENTS

| | | | |
|---|---|---|---|
| 3,612,526 | 10/1971 | Brull | 273/73 H X |
| 3,625,512 | 12/1971 | Latham | 273/73 H X |
| 3,968,561 | 7/1976 | Oakes et al. | 273/73 H X |
| 5,014,987 | 5/1991 | Soong | 273/73 C |
| 5,076,583 | 12/1991 | Hsu | 273/73 C |
| 5,184,818 | 2/1993 | Lo | 273/73 C X |

FOREIGN PATENT DOCUMENTS

| | | | |
|---|---|---|---|
| 2270908 | 12/1975 | France | 273/73 C |
| 344422 | of 1886 | United Kingdom | 273/73 K |
| 2056863 | 3/1981 | United Kingdom | 273/73 C |

*Primary Examiner*—William E. Stoll

*Attorney, Agent, or Firm*—Morton J. Rosenberg; David I. Klein

[57] ABSTRACT

A game racket frame has a head frame, a handle, and a connecting portion located between the head frame and the handle. The game racket frame comprises a segment between the front end of the head frame and the rear end of the connecting portion. With the exception of the line groove of the outer wall of the head frame, the segment has a rib plate of a predetermined length, which is arranged in the inner wall or the outer wall and is folded in a direction toward the opposite wall. The rib plate is connected with the top end or the bottom end of the head frame by a connecting plate. A folding line is constructed between the rib plate and the connecting plate. The game racket frame is therefore provided with an appropriate strength and a good ball-controlling capability.

5 Claims, 5 Drawing Sheets

GAME RACKET FRAME

BACKGROUND OF THE INVENTION

The present invention relates to a game racket, and more particularly to a game racket having a superior structural strength and an excellent ball-striking capability.

Generally speaking, a game racket of the prior art does not afford simultaneously a powerful ball-striking force and an excellent ball-controlling capability. The ability of the game racket to deliver a powerful ball-striking force is dependent directly on the weight and the rigidity of the game racket frame. In other words, the ball-striking power of the game racket is directly proportional to the weight of the game racket frame. As the rigidity of the game racket frame increases, the swinging range of the game racket frame becomes smaller to bring about a greater ball-striking power and a poorer ball-controlling capability.

Three side elevational views of three different racket frame of the prior art are shown in FIGS. 1, 2 and 3. All three game racket frames are different in thickness and differ in that they comprise the corresponding portions which are different in thickness so as to enhance the strength and the ball-controlling capability of the game racket. The rigidity of the game racket frame must be so enhanced as to improve the strength of the game racket at the expense of the ball-controlling capability of the game racket. It is obvious that each of these three game racket frames of the prior art has failed to afford simultaneously a powerful ball-striking force and an excellent ball-controlling capability.

SUMMARY OF THE INVENTION

It is therefore the primary objective of the present invention to provide a game racket frame, which has a rib plate disposed on a side wall in a manner that it extends toward another side wall and which has a connecting plate serving to connect the rib plate with the frame top end and the frame bottom end of the game racket. Formed between the rib plate and the connecting plate is a folding line, so as to bring the inner and the outer side walls closer together after the connecting plate and the rib plate have been connected. Upon hitting a ball, the string generates a pulling force, which causes the outer wall to move, thereby resulting in the network of the head frame to deform so as to prolong the dwelling time of the ball. In the meantime, the rib plate serves to resist the thrust of the ball so that the swinging range of the game racket is reduced without undermining the ball-striking power of the game racket.

It is another objective of the present invention to provide a game racket frame, which has a connecting plate extending toward the outside of a top end and a bottom end of the game racket frame, so as to form a projection. As a result, only an additional milling work of the molding tool, which is used in making the game racket, is called for.

In keeping with the principles of the present invention, the foregoing objectives of the present invention are accomplished by a game racket frame, which comprises an oval head frame composed of an inner wall and an outer wall and of a plurality of string holes piercing through the inner wall and the outer wall for the strings to interlace to from a network in the head frame. The game racket frame further comprises a handle for use as a hand grip and a connecting portion located between the head frame and the handle. The game racket frame is characterized in that the head frame of the game racket is provided with a rib plate which is located in a segment between the front end and the rear end of the connecting portion. With the exception of a portion containing a line groove, the inner and the outer walls of the segment have the rib plate of a predetermined length, which is connected with the top end and the bottom end of the frame by means of a connecting plate. Formed between the rib plate and the connecting plate is a folding line.

The foregoing objectives, structures, features and functions of the present invention will be better understood by studying the following detailed description of the present invention, in conjunction with the drawings provided herewith.

DETAILED DESCRIPTION OF THE PREFERRED EMBODIMENTS

Figure 1:
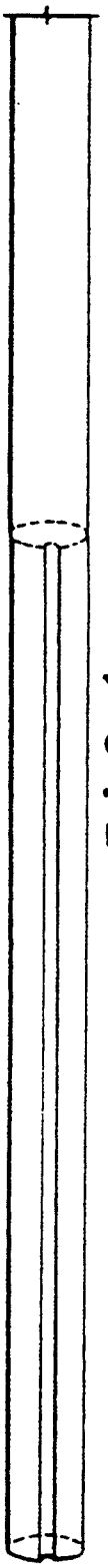
FIGS. 1–3 show side elevational views of three game racket frames of the prior art.
Figure 2:
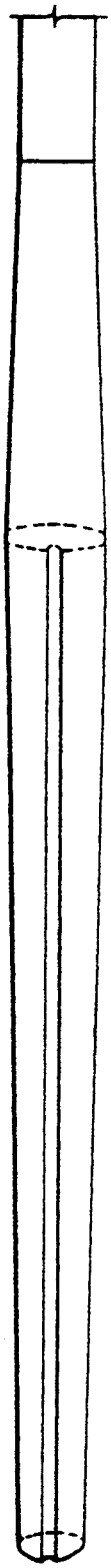
Figure 3:
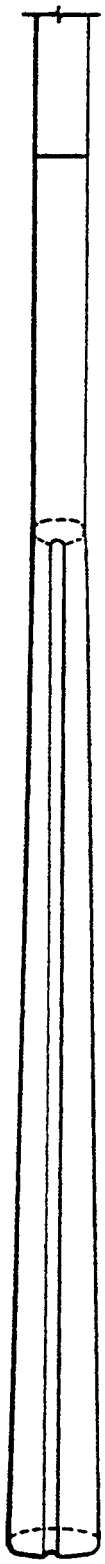
Figure 5:
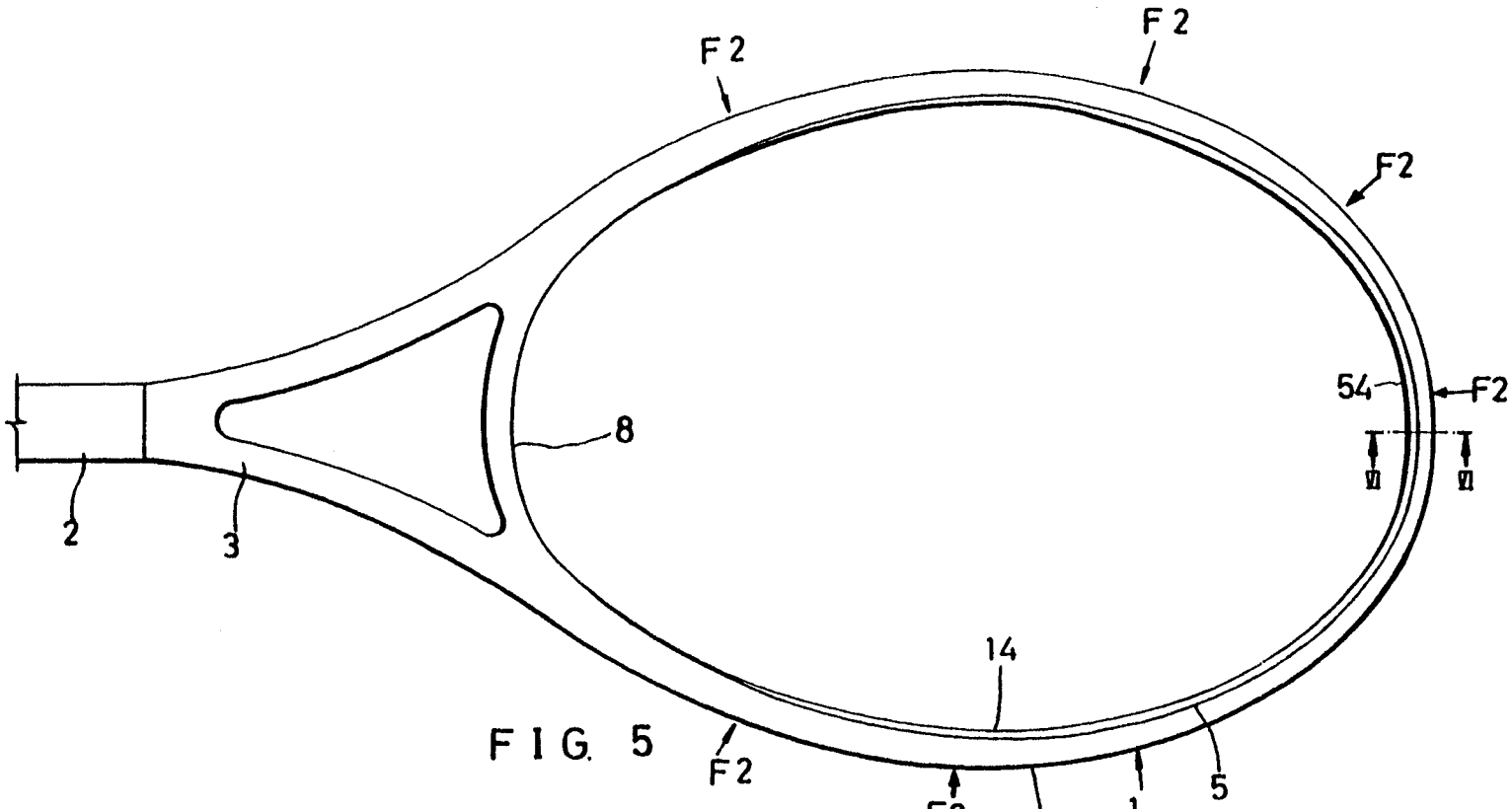
FIG. 5 shows a front elevational view of the first preferred embodiment of the present invention.
Figure 4:
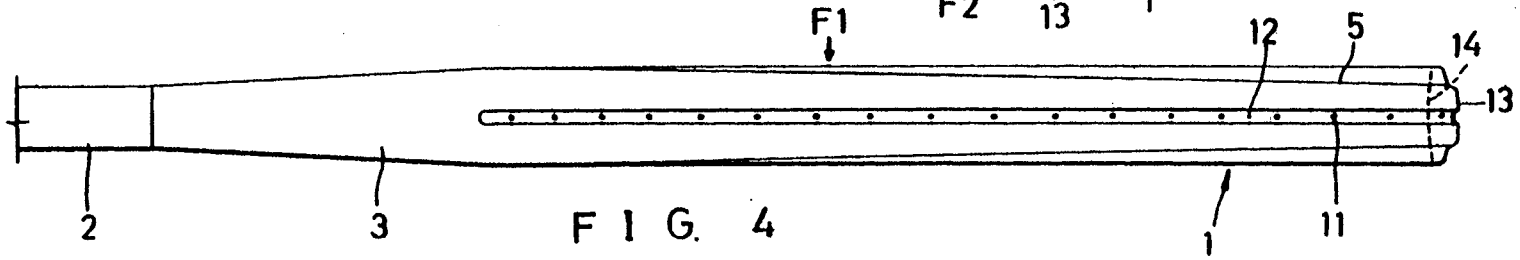
FIG. 4 shows a side elevational view of a first preferred embodiment of the present invention.
Figure 6:
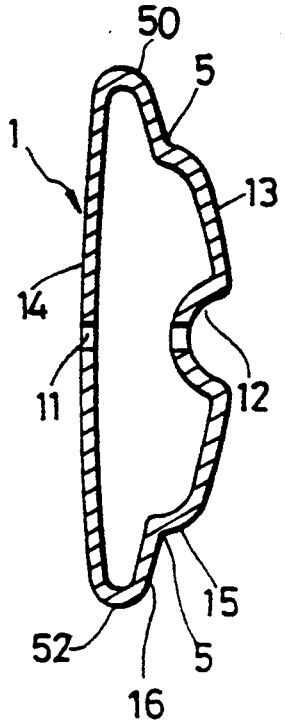
FIG. 6 shows a sectional view of a portion taken along the line VI—VI as shown in FIG. 5.

Referring to FIGS. 4–6, a game racket frame of the present invention is shown to comprise an oval head frame 1, a handle 2 for use as a hand grip, and a connecting portion 3 located between the head frame 1 and the handle 2. The head frame 1 is composed of an outer wall 13, an inner wall 14, and a plurality of string holes 11 piercing through the outer wall 13 and the inner wall 14 for strings to interlace to form a ball-striking network. The front end 54 of the head frame 1 and the rear end 8 is connected to the handle 2 by the connecting portion 3 which is a segment which has a uniform cross-sectional height and which forms an isoelevational segment of the game racket frame. With the exception of the outer wall 13 containing a line groove 12, the outer wall 13 of the isoelevational segment has a rib plate 15 folding toward the inner wall 14. The rib plate 15 is connected with the cross-sectional top and bottom ends 50 and 52 of the game racket frame by means of a connecting plate 16 shown in FIG. 6. Located between the rib plate 15 and the connecting plate 16 is a folding line 5, which curves inwards. These two folding lines 5 are respectively situated at both sides of a line groove 12. The connecting portion 3 of the game racket frame has the greatest cross-sectional height while the front end of the head frame 1 has the smallest cross-sectional height. Therefore, the distance between the two folding line 6 becomes progressively smaller from the front end of the connecting portion 3 toward the front end of the head frame 1, as shown in FIG. 4.

The outer wall 13 of the game racket frame of the present invention is reinforced by the rib plate 15 which is resistant to an impact of a ball or an object, as indicated by an arrow F1 in FIG. 4. As a result, the bending strength of the outer wall 13 is greatly enhanced.

Figure 7:
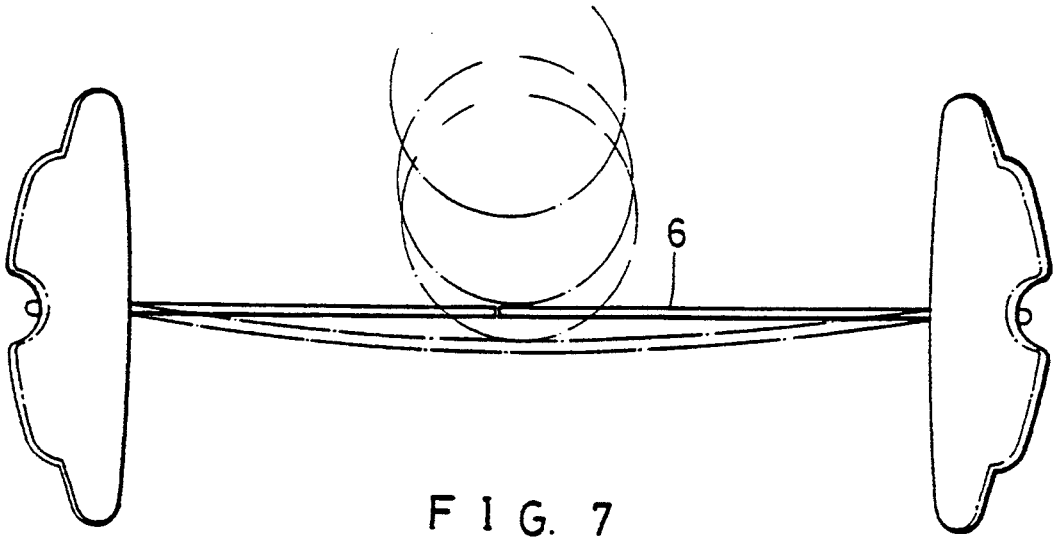
FIG. 7 is a schematic view of the present invention, showing that a ball-striking surface is deformed by the movement of the outer wall caused by an impact of a ball hitting the ball-striking surface.

The rib plate 15 of the outer wall 13 is arranged in a manner that it is folded in a direction toward the inner wall 14. Therefore, the distance between the connecting plate 16 and the inner wall 14 is so small as to permit a force, which is indicated by an arrow F2 in FIG. 5, to cause the outer wall 13 of the head frame 1 to move inwards, thereby bringing about a greater distortion of a ball-striking surface 6, as shown in FIG. 7. As a result, the dwelling time of a ball is so prolonged as to improve the ball-controlling capability of the game racket of the present invention. In addition, the game racket of the present invention is less vulnerable to vibration cause by an impact of the ball.

Figure 8:
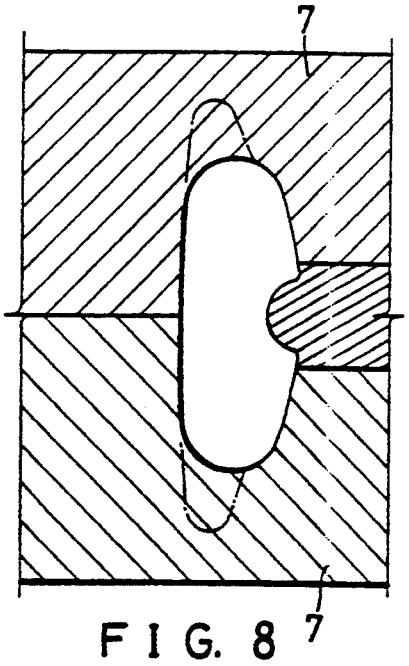
FIG. 8 is a schematic view showing the retooling of the molding tool for use in making the game racket of the present invention.

The FIG. 8 shows that a molding tool 7 is retooled for use in making the game racket of the present invention.

Figure 9:
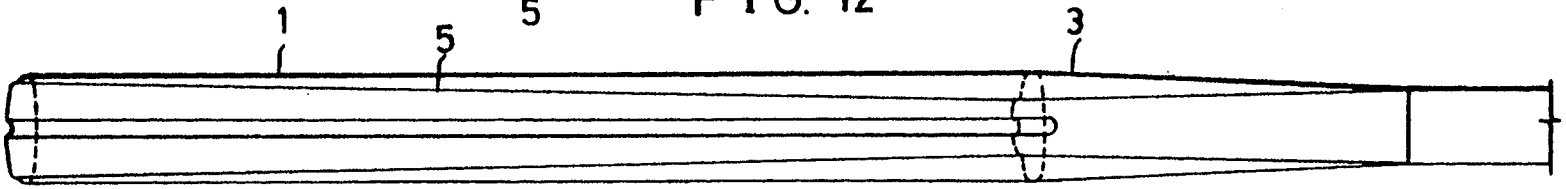
FIG. 9 shows a side elevational view of a second preferred embodiment of the present invention.

The second preferred embodiment of the present invention is illustrated in FIG. 9, in which an isoelevational segment of the game racket is shown comprising two folding lines 5, which are arranged in a manner that the distance between the two folding lines 5 becomes progressively smaller from the front end of the head frame 1 toward the front end of the connecting portion 3.

Figure 10:
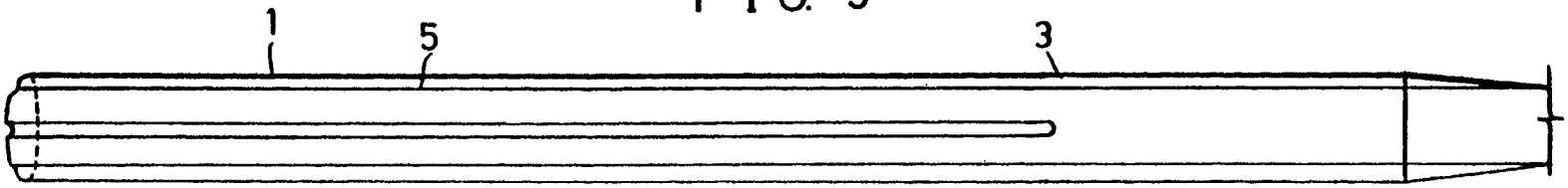
FIG. 10 shows a side elevational view of a third preferred embodiment of the present invention.

The third preferred embodiment of the present invention is illustrated in FIG. 10, in which the two folding lines 5 are parallel to each other from the front end of the head frame 1 to the rear end of the connecting portion 3.

Figure 11:
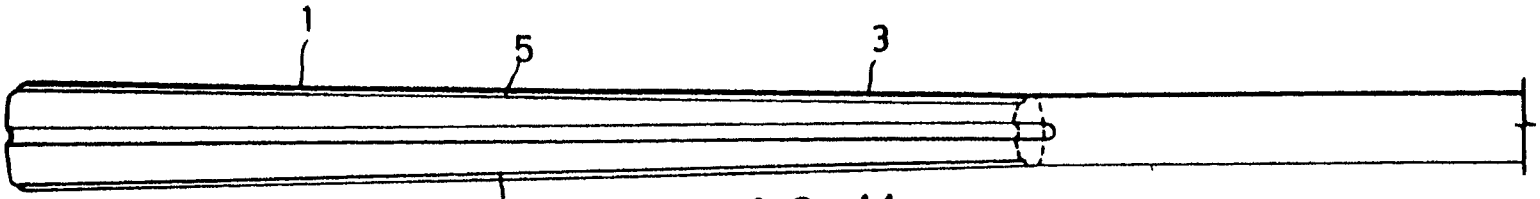
FIG. 11 shows a side elevational view of a fourth preferred embodiment of the present invention.
Figure 12:
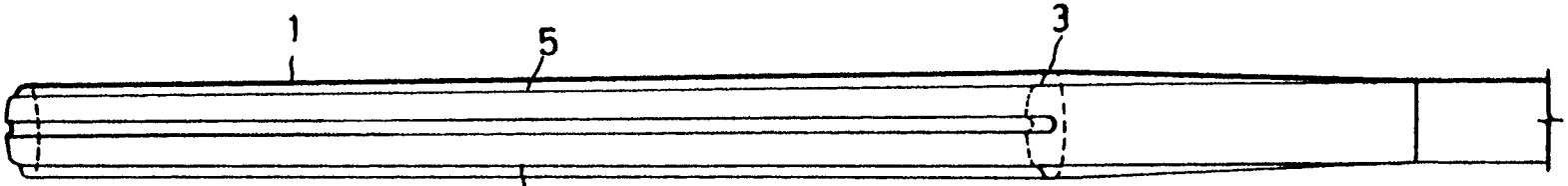
FIG. 12 shows a side elevational view of a fifth preferred embodiment of the present invention.

The fourth and the fifth preferred embodiments of the present invention are shown respectively in FIGS. 11 and 12, in which both embodiments are shown to be devoid of an isoelevational segment. However, the two folding lines 5 are shown to extend in a manner that they are parallel to the top and the bottom ends of the game racket frame. Such modification does not prevent the objectives of the present invention from being achieved effectively.

Figure 13:
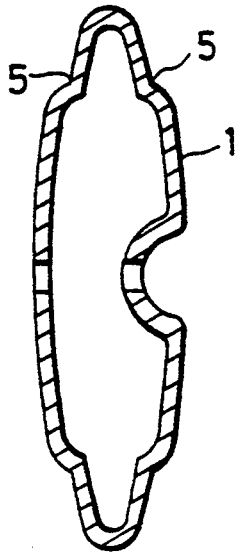
FIG. 13 shows a sectional view of a sixth preferred embodiment of the present invention.
Figure 14:
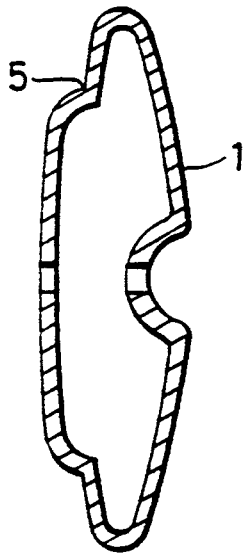
FIG. 14 shows a sectional view of a seventh preferred embodiment of the present invention.

The sixth and the seventh preferred embodiments of the present invention are shown respectively in FIGS. 13 and 14 and are shown to comprise a head frame 1 having a folding line 5 in the inner wall or two folding lines 5 located respectively in the inner wall and the outer wall.

Figure 15:
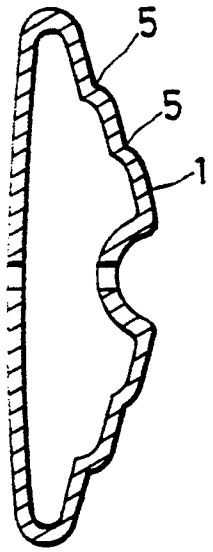
FIG. 15 shows a sectional view of an eighth preferred embodiment of the present invention.

As shown in FIG. 15, the eighth preferred embodiment of the present invention comprises four folding lines 5 in the same side wall. In other words, the number of the folding line 5 in the same side wall can be more than two.

The yoke portion 8 of the game racket frame of the present invention may also comprise the folding line 5. In addition, the folding line 5 may be continuous or interrupted and may be disposed only in a predetermined portion of the head frame 1 or the connecting portion 3.

The embodiment of the present

What is claimed is:

1. A game racket frame having an oval head frame having a front end section and a read end section, said game racket frame having a connecting section for joining said oval head frame to a handle of said game racket frame, said oval head frame defining cross-sectional top and bottom sections, comprising:

an oval head frame inner wall and an oval head frame outer wall each defining a plurality of string holes formed therethrough, said oval frame inner wall forming an arcuate contour in cross-section, said oval head frame inner and outer walls being spaced apart each from the other;

a portion of one of the inner and outer walls located between the front end section and the rear end section having a rib plate direction in an inclined manner with respect to an opposing one of said inner and outer walls;

a connecting plate connecting said rib plate with one of said top and bottom sections of said oval head frame to form a folding line at the juncture of the connecting plate and the rib plate;

a line groove having a predetermined depth defined by and located in said outer wall, said line groove having said string holes located therein through said outer wall in substantial alignment with respective string holes formed through said inner wall; and, a first pair of folding lines formed in said outer wall and disposed on opposing sides of said line groove, said first pair of folding lines extending from said connecting section to said oval head frame front end section in a manner that the displaced distance between said first pair of folding lines decreases from said connecting section to said frame front end section.

2. The game racket frame as recited in claim 1 wherein said inner wall of said head frame includes a second pair of folding lines formed therein extending from said connecting section to said oval head frame front end section and disposed in a manner that said second pair of folding lines are separated by a distance which is at least greater than said predetermined depth of said line groove of said outer wall.

3. The game racket frame as recited in claim 2, wherein said second pair of folding lines extend from said front end section of said oval head frame to a front end of said connecting section in a manner that said second pair of folding lines are parallel to each other.

4. The game racket frame as recited in claim 2 wherein said second pair of folding lines extend from said front end section of said head frame to a front end of said connecting section in a manner that said second pair of folding lines become progressively closer each to the other.

5. The game racket frame as recited in claim 1 wherein a section between said front end section of said oval head frame and said connecting section has a cross-sectional height substantially uniform throughout said section.

* * * * *